United States Patent [19]

Mueller

[11] 4,232,530

[45] Nov. 11, 1980

[54] HEAT PUMP SYSTEM COMPRESSOR START FAULT DETECTOR

[75] Inventor: Dale A. Mueller, St. Paul, Minn.

[73] Assignee: Honeywell Inc., Minneapolis, Minn.

[21] Appl. No.: 57,135

[22] Filed: Jul. 12, 1979

[51] Int. Cl.[3] ..... F25B 13/00; F25B 49/00

[52] U.S. Cl. ..... 62/160; 62/126; 62/209

[58] Field of Search ..... 62/126, 160, 209, 208, 62/228 R, 158

[56] References Cited

U.S. PATENT DOCUMENTS

| | | | |
|---|---|---|---|
| 2,826,044 | 3/1958 | Reer | 62/126 |
| 3,170,304 | 2/1965 | Hale | 62/155 |
| 3,702,064 | 11/1972 | Ciolli | 62/228 R X |
| 4,005,585 | 2/1977 | Matthews | 62/158 |
| 4,034,570 | 7/1977 | Anderson et al. | 62/158 |
| 4,038,061 | 7/1977 | Anderson et al. | 62/126 |

*Primary Examiner*—William E. Wayner
*Assistant Examiner*—Harry B. Tanner
*Attorney, Agent, or Firm*—Roger W. Jensen

[57] ABSTRACT

A compressor start fault detection and control system for a reverse cycle refrigeration system for detecting faulty compressor startup operation and for controlling the system in response to the detection of a fault by inhibiting the compressor and for providing a fault indication, the control system comprising a controller means receiving an input indicative of the temperature of the compressor discharge refrigerant and an output indicative of a demand from a building temperature sensing means for heating or cooling of the building. The controller means also includes (i) timing means, (ii) means for comparing the value of the compressor discharge temperature at the time of compressor start up and the value of the compressor discharge temperature after the compressor has been operating for a preselected time interval and (iii) means to inhibit any further operation of the compressor means unless the value of the later compressor discharge temperature is greater than the value of the initial or start up compressor disclosing temperature plus a preselected constant.

8 Claims, 3 Drawing Figures

HEAT PUMP SYSTEM COMPRESSOR START FAULT DETECTOR

BACKGROUND OF THE INVENTION

One significant problem with heat pumps is a possible system malfunction whereby the room thermostat in the room to be heated and/or cooled by the heat pump commands compressor operation so as to either heat or cool the space but the compressor either does not operate or, in some cases, cycles on and off. Another system malfunction is where the compressor is energized and running but is not compressing the refrigerant; this is exemplified by the compressor valve failures and/or the loss of refrigerant. There are no obvious indications of these faults to a person near the thermostat because the compressor is at a location remote from that of the thermostat. This, in turn, with many systems, can mean (when the thermostat is calling for heating of the building) that auxiliary electric resistance heating is automatically used to heat the building; i.e., a backup heating system; however, this usually results in a much higher cost of heating. Accordingly, various prior art schemes have been devised for attempting to detect whether or not the compressor is running, or is running without refrigerant in the system, but all of these prior art arrangements have one or more shortcomings. For example, one prior scheme is to use the pressure of the refrigerant at the discharge side of the compressor; however, this does not provide a reliable enough signal. Also, it has been proposed that the value or magnitude of the electric current and/or electric voltage energizing the motor driving the compressor be monitored; however, these schemes only indicate that the motor is being powered and do not confirm that the compressor is actually pumping refrigerant.

This invention is an improvement over the invention disclosed in the copending application of Dale A. Mueller and Stephen L. Serber, Ser. No. 954,266, filed Oct. 24, 1978, now abandoned. Briefly, the present invention provides superior results to those of said copending application in detecting compressor startup problems and for providing appropriate control functions. More specifically, the present invention provides a more reliable control for detecting a defective compressor operation at the time of start up. For example, a heat pump unit may be housed in an enclosure which retains heat therein generated by the heat pump unit per se, e.g. by crank-case heaters, by solar effects, etc; the "artificially" high temperatures of the enclosure in turn would escalate the temperature sensed by the compressor discharge temperature sensor so as to possibly erroneously signal that the compressor was operating correctly when in fact the opposite was true. Also, there are times when it is difficult to obtain a large enough, e.g. 50° F., rise in the compressor discharge temperature in the nominal time period, e.g. 5 minutes, required by the system of said copending application.

Accordingly, an object of the present invention is to provide a new and significantly improved compressor fault detection system for a reverse cycle refrigeration system.

SUMMARY OF THE INVENTION

The present invention is a compressor fault detection and control system for a reverse cycle refrigeration system comprising the usual refrigeration compression means, indoor coil, outdoor coil, refrigerant conduit means connecting the compression means and the coils, and refrigerant compression control means. In particular, the compression fault detection and control system comprises compressor discharge sensing means having an output indicative of the temperature of the refrigerant discharged from the refrigerant compression means, building temperature sensing means having an output indicative of a demand for heating or cooling of the building, and a special controller means. The special controller means has operative connections to the above recited temperature sensing means so as to receive the outputs thereof. The controller has a timing function which is initiated upon the starting or commencement of operation of the compressor. The controller means further includes a circuit connection-disconnection means for selectively interconnecting the building temperature sensing means to the refrigerant compression control means, the building temperature sensing means output normally being connected to the refrigerant compression control means so as to cause the compressor to run or operate whenever there is a demand for heating or cooling of the building. The controller means further is characterized by being adapted to inhibit the operation of the compressor means if, after a predetermined time interval as measured by the timing means, the value of the compressor discharge temperature is less than the value of the initial or start up compressor discharge temperature plus a preselected constant.

The invention may further include outdoor air temperature sensing means having an output indicative of outdoor air temperature and also a means of monitoring the operation of the compressor after the abvoe described system has already established that the compressor is running in a satisfactory manner. Said post start up means of monitoring a compressor includes a means for comparing the value of the compressor discharge temperature and the outdoor air temperature and for inhibiting the operation of the compressor means if, after a predetermined time interval, the value of the compressor discharge temperature is less than the value of the outdoor air temperature plus a preselected constant. Further, the apparatus may comprise a means for measuring the post compressor start up discharge temperature at preselected intervals of time and comparing successive temperature measurements and inhibiting the further operation of the compressor if, at the end of each interval, it is found that the most recent temperature measurement is less than the preceding temperature measurement by more than a preselected variance.

DESCRIPTION OF THE PREFERRED EMBODIMENT

Figure 1:
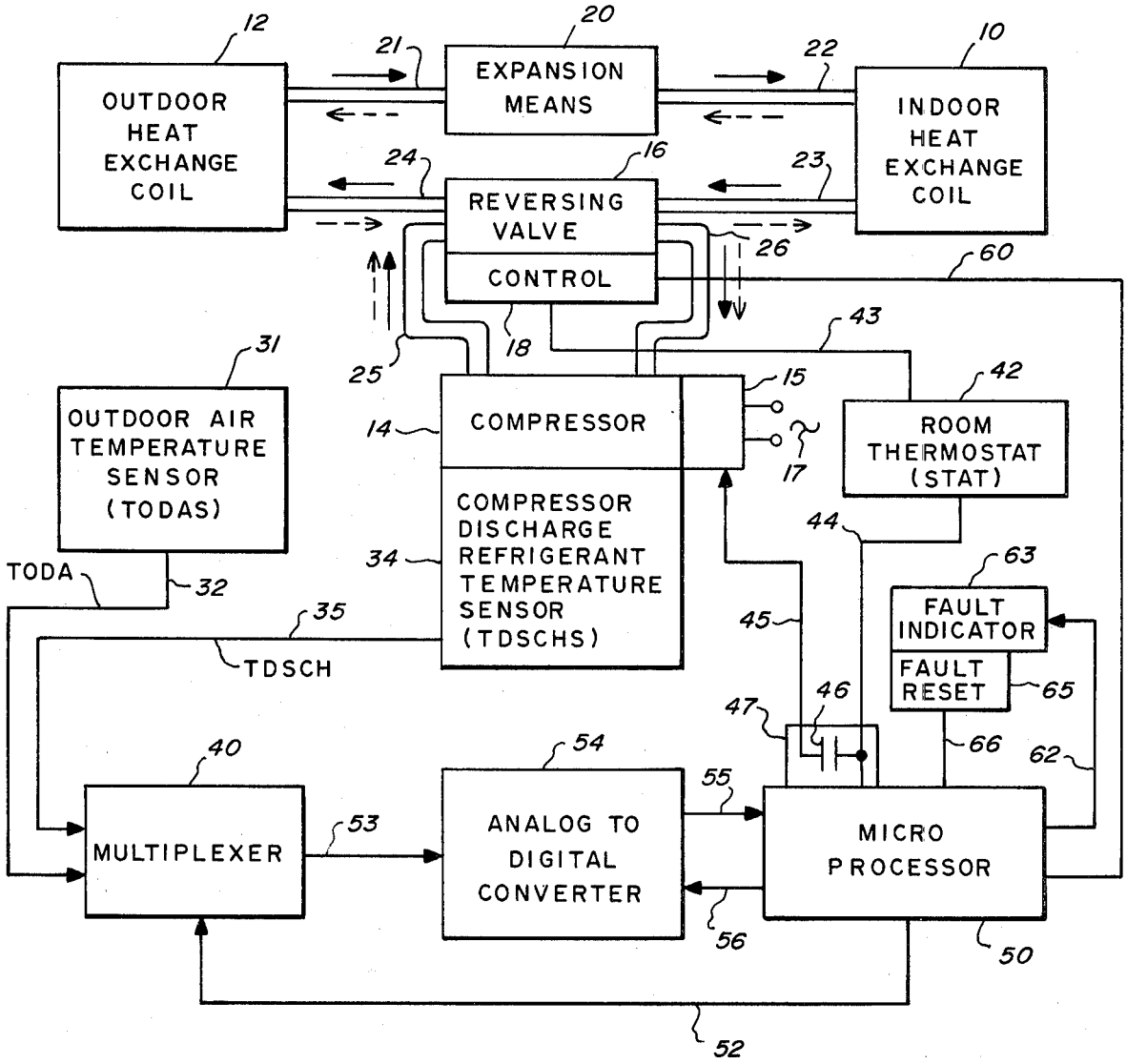
FIG. 1 is a block diagram of a compressor fault detection and control system for a reverse cycle refrigeration cystem embodying the present invention.

Referring to FIG. 1, the reverse cycle refrigeration system comprises an indoor heat exchange coil 10, an outdoor heat exchange coil 12, a refrigerant compression means or compressor 14, a compressor controller 15 energized from an appropriate source 17 of electrical energy, and refrigerant conduit means interconnecting the coils and compressor, the conduit means including the usual reversing valve 16 having a controller 18, an expansion means 20, and appropriate interconnecting piping 21–26. The system above described is representative of prior art systems such as that shown in the U.S. Pat. No. 3,170,304. As is well known, such systems function whenever the building thermostat is calling for heating or cooling to cause the compressor 14 to operate. If heating is being demanded, then the compressed hot refrigerant from the compressor 14 will be routed through the reversing valve 16 toward the indoor heat exchange coil 10 where its heat is given up to heat indoor air. Conversely, if cooling of the building is being demanded, then the hot refrigerant from the compressor is routed through the reversing valve to the outdoor heat exchange coil where the refrigerant is cooled for subsequent use indoors to cool the building.

The compressor fault detection and control system as depicted in FIG. 1 comprises an outdoor air temperature sensing means 31 (hereinafter sometimes referred to as "TODAS") having an output 32 on which is a signal indicative of the outdoor air temperature (hereinafter sometimes referred to as "TODA"). TODA on 32 comprises one of two inputs to a multiplexer 40 to be described in more detail below. The compressor fault detection and control system further comprises a compressor discharge refrigerant temperature sensing means (hereinafter sometimes referred to as "TDSCHS") 34 having an output 35 (connected to multiplexer 40 as the second input thereof) on which is a signal indicative of the temperature of the refrigerant on the discharge side of compressor 14, said temperature hereinafter sometimes being referred to as "TDSCH" and the detection and control system further includes a room thermostat 42 (hereinafter sometimes referred to as "STAT") which responds to the temperature of a room or space in a building or the like, the temperature of which is to be controlled by the reverse cycle refrigeration system. Room thermostat 42 is depicted as having a first output 43 connected to the control 18 for the reversing valve 16 and a second output 44 connected to a microprocessor 50 and also, through a set of normally closed contacts 46 and a connection means 45, to the controller 15 of compressor 14. Contacts 46 are contained within a subsection 47 of the microprocessor 50 and both 47 and 50 will be described in more detail below.

A Honeywell Inc. Model T872 heating-cooling thermostat may be used for the room thermostat 42 depicted in FIG. 1, the Model T872 being of the bimetal operated mercury switch type including switch means for providing the heating-cooling control signals and also for controlling a plurality of auxiliary heating means. As will be understood, whenever STAT 42 calls for either heating or cooling of the controlled space, then a control signal is effectively supplied on outputs 43 and 44 thereof; the control signal at 43 functioning to position via control 18 the reversing valve 16 to the proper orientation for either heating or cooling of the building and the control signal at 44 being transmitted through the normally closed contacts 46 and connection 45 to control the compressor 14 from a rest or "off" position to an operating or "on" condition. The control signal at 44 is also applied to the microprocessor 50 to indicate a demand for compressor 14 operation.

Further, Honeywell Inc. platinum film resistance type temperature sensors models C800A and C800C may be used for TODAS 31 and TDSCHS 34 respectively. Also, a Westinghouse Inc. HI-RE-LI unit comprising an outdoor unit model no. HL036COW and indoor unit AG012HOK may be used for the basic heat pump unit depicted in FIG. 1, i.e., components 10, 12, 14, 15, and 16.

Multiplexer 40 thus has applied thereto at 32 and 35 analog signals representative of TODA and TDSCH respectively. The function of the multiplexer 40 is to supply one or the other of the two input signals in analog form to the output 53 thereof, depending upon the nature of the control signal being applied to the multiplexer 40 via a lead 52 from the microprocessor 50; i.e., the microproccessor provides a control for the multiplexer 40 to select which of the two input signals is applied to output 53. Output 53 is applied as the input to a standard analog-to-digital converter 54 (hereinafter sometimes referred to as "A/O") having an output 55 connected as a second input to the microprocessor 50 and also having an input 56 for receiving controlling instructions from the microprocessor 50. The output from analog-to-digital convertor 54 at output 55 is a signal in digital form indicative of the analog signal applied to input 53.

The microprocessor has a first output connection 60 which is connected to the control 18 of the reversing valve 16 so as if desired, to control the reversing valve independently of the control supplied to 18 from the room thermostat 42. The microprocessor 50 has a second output 62 connected to a suitable fault indicator 63 such as a warning light and/or audible alarm or the like. The apparatus further includes a suitable fault reset means 65 (such as a switch) having an output 66 which constitutes a third input to the microprocessor 50.

A suitable microprocessor that may be used in the present invention as a component of the system depicted in FIG. 1 is the Intel Corporation Model 8049; a suitable representative analog-to-digital convertor for use to provide the function of block 54 in FIG. 1 is the Texas Instrument Inc. Model TL505C (see TI Bulletin DL-S 12580); and an appropriate multiplexer is the Motorola Inc. Model MC14051BP.

It will be understood by those skilled in the art that the functional interconnections depicted in FIG. 1 are representative of one or more electrical wires or pipes, as the case may be, as dictated by the specific equipment used.

Figure 2A:
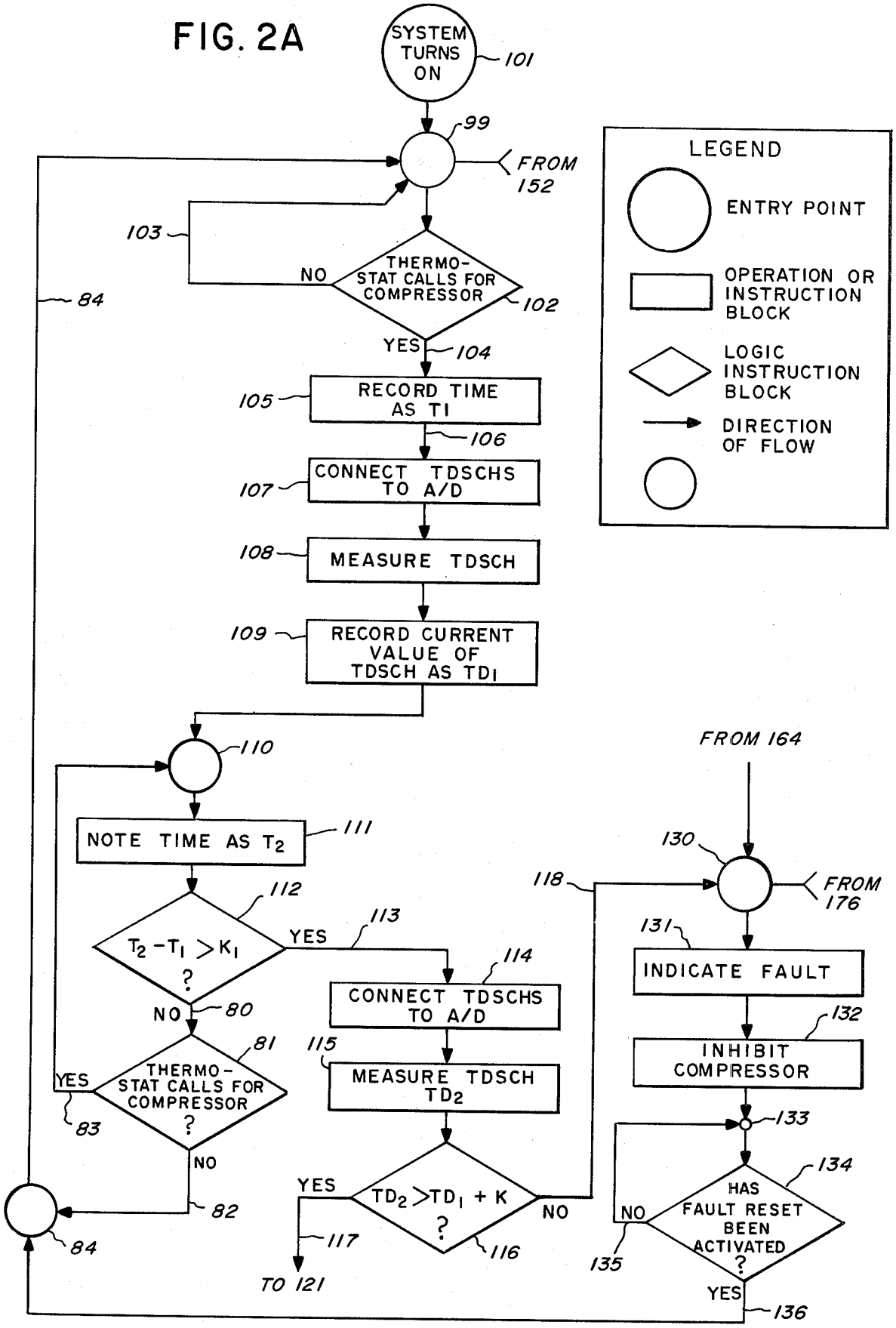
FIGS. 2A and 2B comprise a flow chart for the control of the apparatus shown in FIG. 1.
Figure 2B:
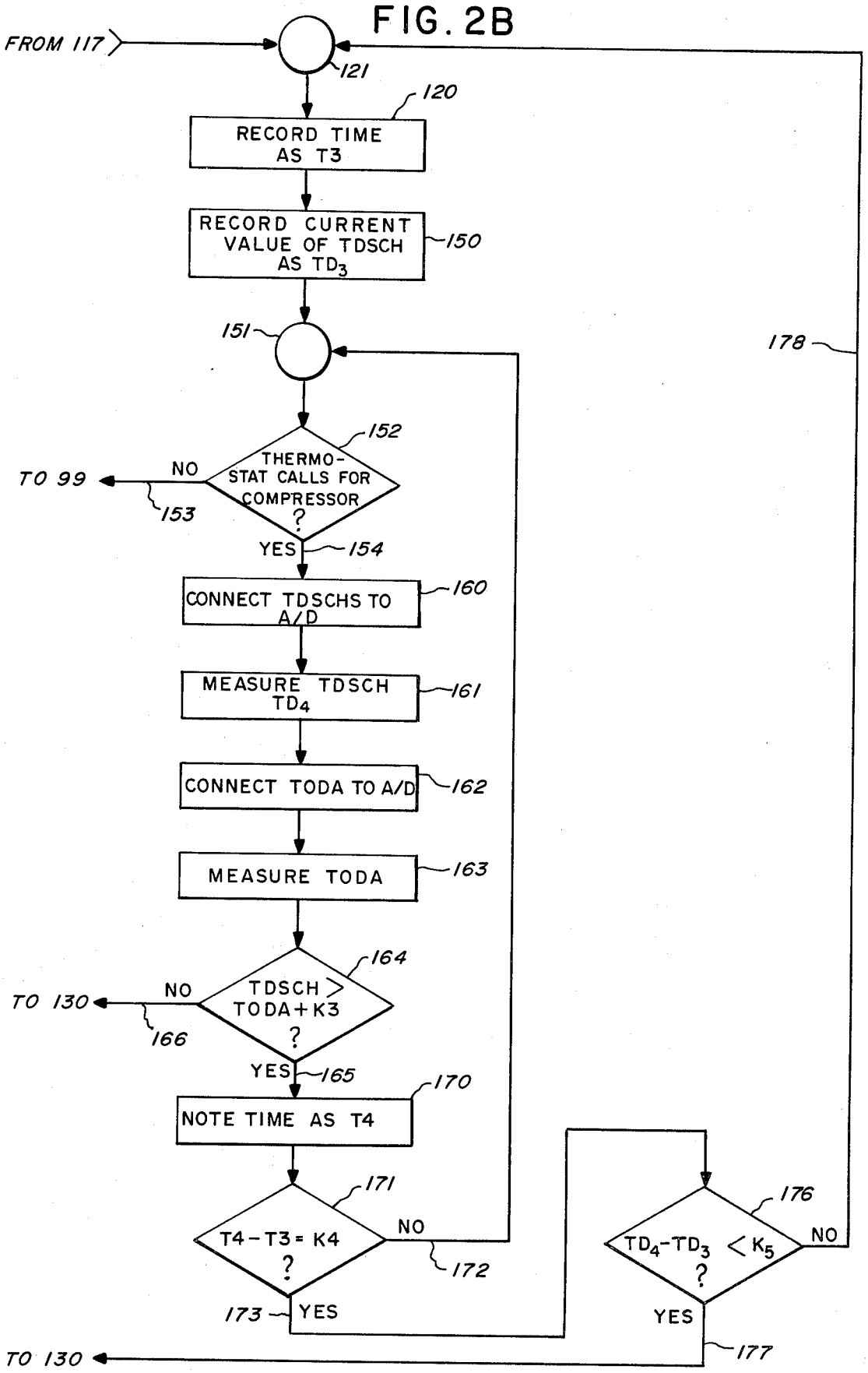

The detailed operation of the compressor fault detection and control system of FIG. 1 may be more specifically understood by reference to the flowcharts depicted in FIGS. 2A and 2B.

Referring to FIG. 2A, an entry point 101 "system turns on" reflects the status of the heat pump being powered up; i.e., power 17 being applied to compressor-controller 15 and any required control system electrical energization also being supplied. The system flows thence via a junction 99 to a logic instruction block 102 "thermostat calls for compressor?" having a "no" response 103 causing flow back to junction 99 where the compressor waits for the STAT to call for compressor operation, and a "yes" response 104 indicating a call by the STAT for compressor 14 to operate which flows to an instruction block 105 "record time as $T_1$". This initiates or starts a timer within microprocessor 50 to enable an elapsed time measurement (T2-T1) operation as will be discussed below. The flow from 105 is through a junction 106 and thence to an instruction block 107 "connect TDSCH to analog-to-digital converter (A/D)," the flow from which is to an instruction block 108 "measure TDSCH" the flow from which is to instruction block 109 "record current value of TDSCHS as $TD_1$," the flow from which is to a junction 110 and thence to an instruction block 111 "note time as T2" and thence to a logic instruction block 112 "$T_2-T_1>K_1$?" having a yes response (indicative of the elapse of predetermined time interval) applied via 113 to instruction blocks 114 "connect TDSCHS to A/D" and 115 "measure TDSCH $TD_2$" and thence to a logic instruction block 116 "$TD_2>TD_1$ & $K_2$?" (indicative of the function of comparing the value of $TD_2$ with the start-up value $TD_1$, plus a preselected constant $K_2$) having a yes response applied via 117 to a junction 121 (see FIG. 2B) and a no response applied via 118 to a junction 130 to (as will be described below) cause an inhibition or shutdown of the compressor. Logic instruction block 112 has a no reponse (indicating that said predetermined time interval has not elapsed) applied via 80 to a logic instruction block 81 "thermostat calls for compressor?" the yes response of which flows via 83 to junction 110 and a no response of which flows via 82 to a junction 84 and thence via 85 to junction 99.

It will be understood that the no response from block 116 is indicative of a faulty compressor; i.e., after a predetermined or preselected period of time (T2 minus T1 is greater than $K_1$; we have found 5 minutes an appropriate value) the compressor has not functioned to raise the discharge temperature to a sufficiently high level as is proved by the functioning of logic instruction block 116. Accordingly, the no response thereof is applied via 118 and junction 130 to an instruction block 131 "indicate fault" (this causes actuation of indicator 63) the flow from which is to an instruction block 132 "inhibit compressor." This then is effective to cause the normally open contacts 46 (of subsection 47 of microprocessor 50) to open so as to interrupt the control of compressor controller 15 by the STAT 42, and to inhibit further compressor operation.

As indicated, a means 65, e.g., a reset switch, is provided in the system to reset the entire fault detection and control system subsequent to a fault being detected and fault indicator 63 being actuated. In FIG. 2A this is reflected by logic instruction block 134 "has fault reset and activated?" which receives the flow from instruction block 132 via a junction 133, having a no response 135 flowing back to the junction 133 and thence to block 134, indicating that reset has not been requested and a yes response flowing via 136 to junction 84 and thence via 85 to junction 99.

Referring to logic instruction block 116 it was noted above that the yes response thereof (indicating that the compressor is operating properly) causes flow via 117 to junction 121 and thence to instruction block 120 "record time as T3," which notes the beginning of a time interval of length $K_4$. The flow from 120 is to instruction block 150 "record current value of TDSCH as $TD_3$," which stores the value of TDSCH at the beginning of said time interval $K_4$, the flow from which is via a junction 151 thence to logic instruction block 152 "thermostat calls for compressor?" having a no response 153 connected to junction 99 indicating that the thermostat is satisfied, and a yes reponse 154 indicating a continuing call for compressor operation, causing flow to an instruction block 160 "connect TDSCHS to A/D" the flow from which is to instruction block 161 "measure TDSCH $TD_4$," the flow from which is to instruction block 162 "connect TODA to A/D", the flow from which is to instruction block 163 "measure TODA", the flow from which is to logic instruction block 164 "TDSCH is greater than TODA plus $K_3$?", all of which is indicative of measuring TDSCH and TODA and comparing their difference with a value $K_3$ which is the minimum difference of such temperatures for which the compressor is considered to be operating properly. A no response 166 (indicating the compressor is not operating properly) causes flow to junction 130 to indicate a fault and inhibit the compressor, and a yes response 165 (indicating proper operation) causes flow to an instruction block 170 "note time as T4," the flow from which is to a logic instruction block 171 "T4 minus T3 equals $K_4$?," a no response 172 therefrom (indicating that time interval $K_4$ has not passed) causing flow by 172 back to junction 151 to repeat the differential temperature measurement, and a yes response (indicating the end of time interval $K_4$) causing flow by 173 to a logic instruction block 176 "$TD_4$ minus $TD_3$ is less than $K_5$?" which compares the difference between $TD_3$, the value of TDSCH at the beginning of the time interval T3 and the present value of TDSCH, i.e., $TD_4$, with the minimum predetermined change in TDSCH $K_5$ to indicate that compressor 14 is operating properly. A no response from 176 indicates that compressor 14 is operating properly, causing flow via 178 to junction 121 to begin a new timing interval by establishing the present time as a new value for the start of the interval T3, and a yes response indicating that compressor 14 is not operating properly, causing flow via 177 back to junction 130 to indicate a fault condition and to inhibit the compressor.

To summarize, it is seen that the apparatus depicted in FIG. 2A is representative of the operation of the compressor fault detection and control system (through the primary control of the microprocessor 50) to determine whether or not the compressor 14 has actually started and is actually compressing the refrigerant in the system a preselected time interval after STAT 42 calls for compressor 14 operation. This time interval gives the compressor an opportunity to raise TDSCH to the level indicative of proper compressor operation. It was noted logic instruction block 102 has a yes response at 104 when the thermostat is calling for a compressor operation; that instructions 105–116 relate to the measurements of TDSCH providing $TD_1$ and $TD_2$ following which logic instruction block 116 determines whether or not the refrigerant discharge temperature $TD_2$ is greater than the start-up temperature TD1 plus the constant $K_2$. A yes response from 116 is indicative of the compressor not only operating but operating in the normal fashion; i.e., compressing the refrigerant. To explain further, when the compressor is functioning in the normal mode, the compressing of the refrigerant causes a substantial increase in the temperature of the refrigerant. Thus, if the compressor refrigerant discharge temperature has not increased substantially after the compressor had been running for a preselected period of time, say five minutes, then this is conclusive evidence that the compressor has a fault and it should be, at least temporarily, stopped so that an inspection may be made for the source of the problem; e.g., a leak of refrigerant, etc. Further, a no response from 116 causes flow via 118 to 130 when the preselected time interval has elapsed; thus, if the discharge temperature $TD_2$ is not hot ehough after the time interval, the no response of 116 causes the indication of a fault through the functioning of instruction block 131 to thus cause the actuation of the fault indicator 63 of FIG. 1. and simultaneously the inhibiting of the compressor 132 which, as explained above, causes the opening of the normally closed contact 46 so as to remove control of the compressor controller 15 from STAT 42.

The fault detection and control system also functions to monitor the operation of the heat pump system during a compressor run; i.e., following the initial determination (described above) that the compressor not only is operating but is actually compressing. Thus, the yes response 119 from logic instruction block 115 flows to junction 121. The apparatus depicted in FIG. 2B generally is representative of the function of periodically measuring the discharge temperature, i.e., at preselected time intervals, and then making comparisons of such successive temperature measurements and inhibiting the further operation of the compressor if, at the end of any such time intervals, it is found that the most recent discharge temperature is less than, or colder than, the preceding discharge temperature measurement by more than a preselected amount.

Thus, the yes reponse 119 causes the initiation of the operation 120 and effectively starts the running of a discharge timer; further, the function of instruction block 150 is to record the beginning value or magnitude of the refrigerant discharge temperature TDSCH, this particular value being identified in block 150 by the abbreviation "$TD_3$." Thereafter, there is a test to confirm that the thermostat is still calling for compressor action (block 152) a yes response 154 therefrom then enabling the operations called out in instruction blocks 160–163 inclusive; i.e., the measurements of TDSCH ($TD_4$) and TODA. Next, a check is made to confirm that the compressor is still running; this is accomplished by the function by logic instruction block 164 (note that once again TDSCH is required to be greater than TODA plus a constant $K_3$); if this block provides a no response 166, the compressor operation is inhibited and the fault indicator 63 actuated; a yes response 165 signifies that the compressor is indeed running; and accordingly, the next instruction block 170 is executed so as to perform the indicated time measurement function following which the logic instruction block 171 compares T4 and T3; if the elapsed time T4−T3 is sufficiently large, i.e., equal to the constant $K_4$, then this signifies that sufficient time has elapsed since the beginning time T3; and accordingly, a yes response causes flow via 173 to permit the logic instruction block 176 to compare the beginning discharge temperature "$TD_3$" with the current or present discharge temperature $TD_4$. As indicated in FIG. 2B at 176, if $TD_4$ minus $TD_3$ is less than the constant $K_5$, then this is a confirmation that the refrigerant compression function has for some reason stopped after initially being satisfactory and that the system should be shut down. Accordingly, the yes response causes flow via 177 to cause a fault indication 131/63 and the inhibiting of the compressor operation 132 by the opening of normally closed contacts 46. If, at 176, $TD_4$ minus $TD_3$ is greater than $K_5$, then the no response 178 causes flow back to junction 121 so that the subsystem recycles, it being understood that this periodic checking of the discharge temperature is a continuous process, i.e., goes on as long as the thermostat is calling for compressor action.

As indicated above, an Intel Model 8049 microprocessor may be used to practice the subject invention; as an assistance, reference may be made to "INTEL ®MCS-48 TM Family of Single Chip Microcomputers—User's Manual," a 1978 copyrighted manual of the Intel Corporation, Santa Clara, Calif. 95051. As a further assistance, Appendix A hereto and forming a part hereof, comprises a table of machine readable instruction for controlling the aforesaid Intel Model 8049 microprocessor for use in the present invention.

It will also be understood by those skilled in the art that the functional interconnections depicted in FIG. 1 are representative of one or more electrical wires or pipes, as the case may be, as dictated by the specific equipment used.

While we have described a preferred embodiment of our invention, it will be understood that the invention is limited only by the scope of the following claims:

I claim:

1. A compressor start fault detection and control system (hereinafter "fault detection system") for a reverse cycle refrigeration system (hereinafter "system") for heating and cooling a building wherein said system comprises refrigerant compression means, refrigerant compression control means, an indoor coil, an outdoor coil, and refrigerant conduit means connecting said compression means and said coils, said fault detection system comprising:

compressor discharge temperature sensing means (hereinafter "TDSCHS") having an output indicative of the temperature (hereinafter "TDSCH") of the refrigerant discharged from said refrigerant discharge means; and building temperature sensing means (hereinafter "STAT") having an output indicative of a demand for heating or cooling of the building; and controller means having operative connections to said TDSCHS and STAT so as to receive the outputs thereof, said controller means including circuit connect-disconnect means selectively interconnecting said STAT output to said refrigerant compression control means whereby when said STAT output is connected thereto said compression means is enabled to operate and when said STAT output is disconnected therefrom said compression means is inhibited from operating, said controller means also including timing means and means for comparing the initial value of TDSCH (hereinafter "$TD_1$") measured at or near the start-up of the compressor and the value of TDSCH (hereinafter "$TD_2$.") after a predetermined time interval measured from the measurement of $TD_1$, and said controller means further being characterized by being adapted to inhibit said compression means from operating if, after a said preselected time interval as measured by said timing means, the value of $TD_2$ is less than the value of $TD_1$ plus said predetermined constant.

2. Apparatus of claim 1 further characterized by said controller means including means for performing post compressor start-up comparisons of the value of TDSCH at predetermined intervals of time and being effective to inhibit the operation of said compression means if, at the completion of one of said time intervals, the then current value of TDSCH minus the value of TDSCH at the beginning of said time interval is less than a predetermined amount.

3. Apparatus of claim 2 further characterized by the inhibiting of said compression means from operating being effected by said controller means operating said connect-disconnect means to disconnect said STAT output from said refrigerant compression control means.

4. A compressor fault detection and control system (hereinafter "fault detection system") for reverse cycle refrigeration system (hereinafter "system") for heating and cooling a building wherein said system comprises refrigerant compression means, refrigerant compression control means, an indoor coil, an outdoor coil, and refrigerant conduit means connecting said compression means and said coils, said fault detection system comprising:

outdoor air temperature sensing means (hereinafter "TODAS") having an output indicative of outdoor air temperature (hereinafter "TODA");

compressor discharge temperature sensing means (hereinafter "TDSCHS") having an output indicative of the temperature (hereinafter "TOSCH") of the refrigerant discharged from said refrigerant discharge means; and controller means having operative connections to said TODAS, TDSCHS, and to said refrigerant compression control means whereby said compression means is enabled to operate or is inhibited from operating, said controller means also including timing means and means for comparing an initial value of TDSCH (hereinafter "$TD_1$") measured at or near the start of the compressor and the value of TDSCH (hereinafter "$TD_2$") after a predetermined time interval after the measurement of $TD_1$, said controller being characterized by being adapted to inhibit said compression means from operating if, after said preselected time interval as measured by said timing means, the value of $TD_2$ is less than the value of $TD_1$ plus a preselected constant, and post compressor start-up compressor shutdown means comprising said controller means including further means for comparing, on a substantially continuous basis, the values of TDSCH and TODA and for inhibiting the operation of said compression means if the value of TDSCH is less than the value of TODA plus a predetermined constant.

5. Apparatus of claim 4 further characterized by the inhibiting of said compression means from operating being effected by said controller means operating said connect-disconnect means to disconnect said STAT output from said refrigerant compression control means.

6. A compressor fault detection and control system (hereinafter "fault detection system") for a reverse cycle refrigeration system (hereinafter "system") for heating and cooling a building wherein said system comprises refrigerant compression means, refrigerant compression control means, an indoor coil, an outdoor coil, and refrigerant conduit means connecting said compression means and said coils, said fault detection system comprising:

outdoor air temperature sensing means (hereinafter "TODAS") having an output indicative of outdoor air temperature (hereinafter "TODA");

compressor discharge temperature sensing means (hereinafter "TDSCHS") having an output indicative of the temperature (hereinafter "TOSCH") of the refrigerant discharged from said refrigerant discharge means; and controller means having operative connections to said TODAS, TDSCHS, and to said refrigerant compression control means whereby said compression means is enabled to operate or is inhibited from operating, said controller means also including timing means and means for comparing an initial value of TDSCH (hereinafter "$TD_1$") measured at or near the start of the compressor and the value of TDSCH (hereinafter "$TD_2$") after a predetermined time interval after the measurement of $TD_1$, said controller being characterized by being adapted to inhibit said compression means from operating if, after said preselected time interval as measured by said timing means, the value of $TD_2$ is less than the value of $TD_1$ plus a preselected constant, first post compressor start-up compressor shutdown means comprising said controller means including means to inhibit said compression means from operating, if, after a said preselected time interval as measured by said timing means, the value of $TD_2$ is less that the value of $TD_1$ plus a predetermined constant, and second post compressor start-up compressor shutdown means comprising said controller means including further means for comparing, on a substantially continuous basis, the values of TDSCH and TODA and for inhibiting the operation of said compression means if the value of TDSCH is less than the value of TODA plus a predetermined constant.

7. Apparatus of claim 6 further characterized by the inhibiting of said compression means from operating being effected by said controller means operating said connect-disconnect means to disconnect said STAT output from said refrigerant compression control means.

8. Apparatus of claim 1 further characterized by the inhibiting of said compression means from operating being effected by said controller means operating said connect-disconnect means to disconnect said STAT output from said refrigerant compression control means.

* * * * *